United States Patent [19]

Sato et al.

[11] Patent Number: 4,734,253

[45] Date of Patent: Mar. 29, 1988

[54] PREPARATION OF SINTERED MAGNETS

[75] Inventors: Kazuo Sato; Shinichi Yamashita, both of Chiba, Japan

[73] Assignee: TDK Corporation, Tokyo, Japan

[21] Appl. No.: 29,955

[22] Filed: Mar. 25, 1987

[30] Foreign Application Priority Data

Mar. 25, 1986 [JP] Japan ..... 61-066499

[51] Int. Cl.[4] ..... B22F 1/00

[52] U.S. Cl. ..... 419/30; 75/244; 75/246; 148/105; 148/108; 252/62.55; 419/38; 419/44; 419/62; 419/66

[58] Field of Search ..... 148/108, 105; 75/244, 75/246; 252/62.55; 419/38, 30, 44, 62, 66

[56] References Cited

U.S. PATENT DOCUMENTS

| | | | |
|---|---|---|---|
| 3,919,004 | 11/1975 | Benz | 148/103 |
| 4,144,060 | 3/1979 | Jandeska et al. | 148/105 |
| 4,325,757 | 4/1982 | Jandeska et al. | 148/103 |
| 4,347,291 | 8/1982 | Tokuoka | 148/105 |
| 4,437,908 | 3/1984 | Inoue | 148/103 |
| 4,514,216 | 4/1985 | Mishima et al. | 148/105 |
| 4,538,130 | 8/1985 | Gluckstern et al. | 335/306 |

*Primary Examiner*—Stephen J. Lechert, Jr.
*Attorney, Agent, or Firm*—Oblon, Fisher, Spivak, McClelland & Maier

[57] ABSTRACT

A sintered magnet of Fe-B-rare earth alloy having an axis of easy magnetization oriented at an angle to a major axis can be directly produced from the alloy material by (a) press molding the material in an applied magnetic field into a compact of the dimensions determined by taking into account factors of shrinkage expected in X, Y and Z directions, and (b) sintering the compact.

14 Claims, 3 Drawing Figures

PREPARATION OF SINTERED MAGNETS

BACKGROUND OF THE INVENTION

This invention relates to the preparation of sintered magnets.

Medical nuclear magnetic resonance computed tomographs (NMR-CT) operating in a magnetic field of 1 to 10 kG (kilogauss) have been developed to represent sectional images of a body. The NMR-CT imaging systems generally use magnetic field generating means in the form of normal conducting magnets or superconducting magnets, with permanent magnets being advantageous because of no power consumption and a weak leakage magnetic field.

One example of permanent magnet circuit is disclosed in Gluckstern et al, U.S. Pat. No. 4,538,130. Referring to FIG. 3, there is illustrated a segmented ring magnet which includes inner and outer magnet groups 2 and 3 each comprising rectangular segments 1 arranged in a ring configuration. The magnet segments 1 each having an axis of easy magnetization as shown by a solid wedge are arranged in the inner and outer magnet groups 2 and 3 so as to produce a uniform upward magnetic field within the interior of the ring. Tuning means is provided for moving at least one magnetic segment radially relative to the ring. There is established a tunable permanent magnet circuit producing a uniform transverse magnetic field.

In the permanent magnet circuit illustrated, those rectangular magnet segments oriented in directions other than the radii of X and Y directions must have an axis of easy magnetization oblique to one side of one rectangular surface thereof.

The magnet materials used in such permanent magnet circuits are preferably sintered magnets of iron-boron-rare earth metal alloys and related materials because of their maximum energy product. Sintered magnets are generally produced by molding a powder of the material under pressure into a compact and sintering the compact. When a compact having an axis of easy magnetization oriented at an angle to one side of its rectangular surface is molded, sintering of the compact deforms the rectangular surface into a parallelogram because Fe-B-rare earth metal materials exhibit a great difference in percent shrinkage upon sintering in the orientation direction and directions perpendicular thereto.

For this reason, it is not a practice to directly produce a sintered rectangular magnet block having an axis of easy magnetization oriented at an angle to one side of its rectangular surface. A common method is by preparing a sintered rectangular magnet block with an easy axis of magnetization oriented parallel to one side thereof and cutting the block along predetermined directions. This method has the disadvantages that not only cutting operations are cumbersome, but the loss of the material wasted reaches 40 to 150% based on the completed product, resulting in an increased cost of material.

Gluckstern et al propose in the above-incorporated patent a method comprising providing a sintered rectangular magnet with an easy axis of magnetization oriented parallel to one side thereof, cutting the magnet along predetermined directions into four elements, and reassembling the elements to form a new rectangular magnet having an axis of easy magnetization of a desired orientation. This method is inconvenient in delicate cutting of sintered magnet and reassembling.

SUMMARY OF THE INVENTION

An object of the present invention is to provide a novel and improved method for producing a sintered magnet, the method having a great advantage in commercial production of a sintered rectangular magnet having an axis of easy magnetization oriented at an angle to one side thereof.

According to the present invention, there is provided a process for preparing a sintered magnet, comprising the steps of:

(a) press molding a magnetic powder into a compact in an applied magnetic field, said compact having coordinates (X/Sx, Y/Sy, Z/Sz) where Sx, Sy and Sz are predetermined factors of shrinkage occurring in a magnetization direction and directions perpendicular to the magnetization direction upon subsequent sintering, and (b) sintering the compact into a sintered magnet having a major axis and an axis of easy magnetization oriented at an angle to the major axis, the sintered magnet having coordinates (X, Y, Z) with X axis aligned with the axis of easy magnetization of the sintered magnet.

BRIEF DESCRIPTION OF THE DRAWINGS

The above and other objects, features, and advantages of the present invention will be more fully understood from the following description taken in conjunction with the accompanying drawings, in which.

DESCRIPTION OF THE PREFERRED EMBODIMENTS

Figure 1:
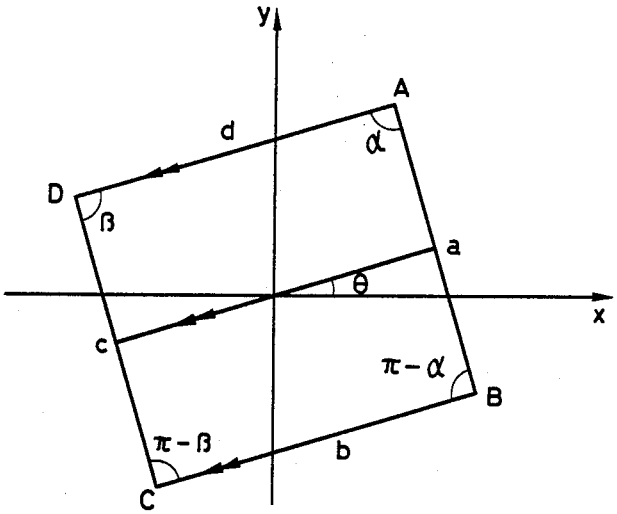
FIGS. 1 and 2 illustrate the configuration and dimensions of a sintered body and a compact according to the present invention.

The sintered magnet produced by the present method may have any of various geometrical three-dimensional shapes. In general, those shapes having at least one pair of parallel extending, particularly polygonal, major surfaces are advantageous because they can be dealt with in a two-dimensional manner. Particularly advantageous among them are those having a polygonal surface having at least one pair of parallel sides because of ease of handling. More illustratively, usually preferred shapes are columnar shapes having a quadrangular surface such as a rectangular, parallelogram or trapezoidal surface, for example, rectangular parallelepiped and frusto-prism shapes. If desired, there may be produced columnar, plate-like, conical or pyramidal objects having a major surface of various polygonal or other shapes with or without parallel sides. Also contemplated are sintered magnets having a ridge, recess, notch, channel or any other modification.

The sintered magnet of such a three-dimensional shape having a major axis has an axis of easy magnetization or orientation at an angle with respect to the major axis. By the term major axis used herein is meant the direction of a phantom center axis for the outer configuration of the sintered magnet. For example, the major axis of a columnar block is a longitudinal center axis, and the major axis of a block having parallel major surfaces is a center line between the major surfaces.

For a block having parallel extending polygonal major surfaces, the easy axis of magnetization intersects at least one side of the polygonal surface substantially within the plane of the surface. For a parallelogram, trapezoidal or rectangular surface having at least a pair of parallel sides, the easy axis of magnetization intersects the paired parallel sides.

By the phrase, intersection of an axis of easy magnetization with a side or orientation of an axis of easy magnetization at an angle to a side, it is intended that the axis of easy magnetization and the major axis, for example, a pair of parallel sides are at an angle between more than 0° and less than 180°. By the phrase substantially within the plane of the major surface, it is intended that the axis of easy magnetization may define an angle of 5° or less with the major surface.

No particular limit is imposed on the size of the magnets.

The material of which the sintered magnets are formed may be selected from ferrite, alnico, and rare earth cobalt alloys, but not limited thereto. Because of high performance promising a compact size, low cost, anisotropy in percent shrinkage during sintering, and ease of application of the present method, iron-boron-rare earth metal materials are recommended. Preferred iron-boron-rare earth metal materials contain 8 to 30 atom percents of at least one rare earth element (including yttrium) selected from Nd, Pr, Ce, Dy, Sm, Tb, La, Ho, Er, Eu, Gd, Pm, Tm, Yb, Lu, and Y, particularly Nd, Pr or Dy, and 2 to 28 atom percents of boron, the balance being iron. Part of the iron may be replaced by less than about 40 atom percents of cobalt. The iron-boron-rare earth metal materials may further contain less than about 13 atom percents of at least one element selected from Ti, Ni, Bi, V, Nb, Ta, Cr, Mo, W, Mn, Al, Sb, Ge, Sn, Zr, Hf and the like. These magnet materials include a major phase of tetragonal crystal system and exhibit an energy product as high as 25 megaoersted (MGOe) or more. Their iHc is of the order of 1 to 25 kilooersted (KOe).

These sintered magnets, particularly Fe-B-rare earth alloy magnets are generally manufactured by melting and casting the alloy composition, finely dividing the cast alloy, and molding the powder in an applied magnetic field, followed by sintering. More illustratively, an alloy ingot is prepared by high-frequency heating the selected ingredients and casting the melt into a water-jacketed mold. It is then finely divided to a particle size of about 1 to 50 μm by means of a stamp mill, ball mill or jet pulverizer. Alternatively, alloy powder may be produced by a reducing diffusion method. Molding or compacting may be carried out under a pressure of about 1 to 3 ton/cm$^2$ in an applied magnetic field of about 3 to 15 KOe. The compact may be sintered by heating at a temperature of about 900° to 1200° C. for about ½ to 10 hours in a non-oxidizing atmosphere.

In the magnet manufacturing process comprising above-described series of steps, the shape and dimensions of the compact should be controlled according to the present invention. The compact resulting from the molding step has a larger volume than the sintered product obtained therefrom and has an outer configuration of the dimensions determined by taking into account predetermined shrinkage factors in three dimensional directions.

For example, in fabricating a product having parallel extending polygonal major surfaces, a compact is designed such that it has corresponding polygonal surfaces of a larger area than the final polygonal surface having an axis of easy magnetization substantially in the plane thereof, and the angle of intersection between a side which becomes one of a pair of parallel sides after sintering and an adjoining side is different from the corresponding angle after sintering.

More illustratively, when it is desired to produce a columnar block having a rectangular cross section or a rectangular parallelepiped block at the end of sintering, sintering starts with a columnar compact having a parallelogram cross section of a larger area. When it is desired to produce a columnar block having a parallelogram cross section at the end of sintering, there is prepared a columnar compact having a parallelogram cross section of a larger area having a different corner angle. When it is desired to produce a trapezoidal pyramid, there is prepared a quadrangular column of a larger area having a different corner angle.

The following description illustrates in detail how to control the dimensions and corner angles of a compact.

First, shrinkage factors $S\|$ and $S\perp$ of a compact during subsequent sintering in a magnetization direction and directions perpendicular to the magnetization direction are determined. The shrinkage factors are readily calculated by press molding a rectangular parallelepiped dimensioned approximately 1–3 cm×1–3 cm×1–3 cm from the magnetic powder in the same magnetic field and pressure as applied in the process, the field being applied parallel to one edge of the rectangular parallelepiped, and sintering the block under the same conditions as used in the process. For Fe-B-rare earth alloys, shrinkage factors $S\|$ and $S\perp$ are approximately 15 to 25% and 5 to 15%, respectively.

Next, a coordinate system is set for a sintered block to be produced by locating the origin at any desired point of the block, for example, at the center of gravity thereof with X axis aligned with the axis of easy magnetization. Then the sintered block has coordinates (X, Y, Z) at an arbitrary position. Since the orientation is in accord with X axis, shrinkage factors Sx (%), Sy (%) and Sz (%), that is, percents of linear shrinkage in the directions of X, Y and Z axes are given by the equations:

$$Sx=(100-S\|)/100,$$

$$Sy=(100-S\perp)/100, \text{ and}$$

$$Sz=(100-S\perp)/100.$$

Then, for the Fe-B-rare earth magnets, Sx = approx. 0.75 to 0.85 and Sy=Sz=approx. 0.85 to 0.95.

The compact is designed such that its coordinates (x, y, z) at the predetermined position satisfy the following equations:

$$X=Sx\cdot x,$$

$$Y=Sy\cdot y, \text{ and}$$

$$Z=Sz\cdot z.$$

The following description refers to a columnar block having parallel extending major surfaces and a major axis aligned with a center line between the major surfaces. Particular reference is made to a columnar block having parallel extending polygonal major surfaces each having a pair of parallel extending edges.

The magnet is now assumed as having an outer configuration of a quadrangular column with the angle of intersection between the parallel extending sides and the axis of easy magnetization (orientation direction) being equal to $\theta$.

A longitudinal cross section of a sintered magnet to be produced is illustrated in FIG. 1 wherein the origin is set at the intersection between straight lines connecting the mid-points of two pairs of opposed sides and the axis of easy magnetization is aligned with X axis. In FIG. 1, side BC is parallel to side DA, and sides AB, BC, CD and DA have lengths of a, b, c and d, respectively. Angles ∠DAB, ∠ABC, ∠BCD and ∠CDA are equal to $\alpha$, $\pi$-$\alpha$, $\pi$-$\beta$, and $\beta$, respectively.

Then points A, B, C and D have the following coordinates (X, Y):

$$A\left(\frac{(d+b)\cos\theta + 2a\cos(\theta+\alpha)}{4}, \frac{(d+b)\sin\theta + 2a\sin(\theta+\alpha)}{4}\right)$$

$$B\left(\frac{(d+b)\cos\theta - 2a\cos(\theta+\alpha)}{4}, \frac{(d+b)\sin\theta - 2a\sin(\theta+\alpha)}{4}\right)$$

$$C\left(-\frac{(d+b)\cos\theta - 2c\cos(\theta-\beta)}{4}, -\frac{(d+b)\sin\theta - 2c\sin(\theta-\beta)}{4}\right)$$

$$D\left(-\frac{(d+b)\cos\theta + 2c\cos(\theta-\beta)}{4}, -\frac{(d+b)\sin\theta + 2c\sin(\theta-\beta)}{4}\right)$$

Figure 2:
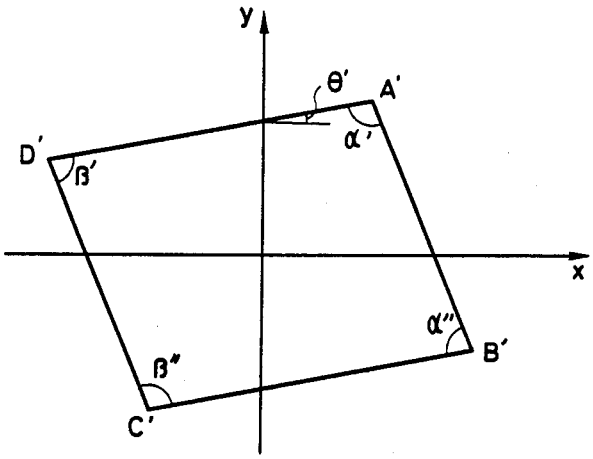

The dimensions and configuration of a compact before sintering will be determined using letters given in conjunction with FIG. 2.

The compact A'B'C'D' has coordinates (x, y) which satisfy the equations:

$X = Sx19\,x$ and $Y = Sy{\cdot}y.$

Then points A', B', C' and D' have the following coordinate:

$$A'\left(\frac{(d+b)\cos\theta + 2a\cos(\theta+\alpha)}{4Sx}, \frac{(d+b)\sin\theta + 2a\sin(\theta+\alpha)}{4Sy}\right)$$

$$B'\left(\frac{(d+b)\cos\theta - 2a\cos(\theta+\alpha)}{4Sx}, \frac{(d+b)\sin\theta - 2a\sin(\theta+\alpha)}{4Sy}\right)$$

$$C'\left(-\frac{(d+b)\cos\theta - 2c\cos(\theta-\beta)}{4Sx}, -\frac{(d+b)\sin\theta - 2c\sin(\theta-\beta)}{4Sy}\right)$$

$$D'\left(-\frac{(d+b)\cos\theta + 2c\cos(\theta-\beta)}{4Sx}, -\frac{(d+b)\sin\theta + 2c\sin(\theta-\beta)}{4Sy}\right)$$

Then, sides A'B', B'C', C'D' and D'A' and angles $\alpha'$, $\alpha''$, $\beta'$ and $\beta''$ are given by the equations:

$$A'B' = a\sqrt{\frac{\cos^2(\theta+\alpha)}{Sx^2} + \frac{\sin^2(\theta+\alpha)}{Sy^2}}$$

$$B'C' = b\sqrt{\frac{\cos^2\theta}{Sx^2} + \frac{\sin^2\theta}{Sy^2}}$$

$$C'D' = c\sqrt{\frac{\cos^2(\theta-\beta)}{Sx^2} + \frac{\sin^2(\theta-\beta)}{Sy^2}}$$

$$D'A' = d\sqrt{\frac{\cos^2\theta}{Sx^2} + \frac{\sin^2\theta}{Sy^2}}$$

$$\alpha' = \cos^{-1}\frac{Sy^2\cos\theta\cos(\theta+\alpha) + Sx^2\sin\theta\sin(\theta+\alpha)}{\sqrt{Sy^2\cos^2(\theta+\alpha) + Sx^2\sin^2(\theta+\alpha)}\ \sqrt{Sy^2\cos^2\theta + Sx^2\sin^2\theta}}$$

$$\alpha'' = \pi - \alpha'$$

$$\beta' = \cos^{-1}\frac{Sy^2\cos\theta\cos(\theta-\beta) + Sx^2\sin\theta\sin(\theta-\beta)}{\sqrt{Sy^2\cos^2(\theta-\beta) + Sx^2\sin^2(\theta-\beta)}\ \sqrt{Sy^2\cos^2\theta + Sx^2\sin^2\theta}}$$

$$\beta'' = \pi - \beta'$$

The angle $\theta'$ of the applied magnetic field relative to side B'C' or D'A' is given by the equation:

$$\theta' = \tan^{-1}\frac{S_x \tan\theta}{S_y}$$

The distance of the compact in the direction of Z axis, that is, major surface-to-major surface distance e') may be equal to that of the sintered product divided by shrinkage factor Sz. Namely, e'=e/Sz.

Reference is now made to a rectangular block as a more illustrative example. For a rectangular product wherein $\alpha=\beta=\pi/2$, a=c, and b=d, the starting compact may have the following equations:

$$A'\left(\frac{b\cos\theta - a\sin\theta}{2Sx}, \frac{b\sin\theta + a\cos\theta}{2Sy}\right)$$

$$B'\left(\frac{b\cos\theta + a\sin\theta}{2Sx}, \frac{b\sin\theta - a\cos\theta}{2Sy}\right)$$

$$C'\left(-\frac{b\cos\theta - a\sin\theta}{2Sx}, -\frac{b\sin\theta + a\cos\theta}{2Sy}\right)$$

$$D'\left(-\frac{b\cos\theta + a\sin\theta}{2Sx}, -\frac{b\sin\theta - a\cos\theta}{2Sy}\right)$$

$$A'B' = C'D' = a\sqrt{\frac{\sin^2\theta}{Sx^2} + \frac{\cos^2\theta}{Sy^2}}$$

$$B'C' = D'A' = b\sqrt{\frac{\cos^2\theta}{Sx^2} + \frac{\sin^2\theta}{Sy^2}}$$

$$\alpha' = \beta'' = \cos^{-1}\frac{Sx^2\sin\theta\cos\theta - Sy^2\cos\theta\sin\theta}{\sqrt{Sy^2\sin^2\theta + Sx^2\cos^2\theta}\sqrt{Sy^2\cos^2\theta + Sx^2\sin^2\theta}}$$

$$\alpha'' = \beta' = \pi - \alpha'$$

Also, the distance of the compact in the direction of Z axis may be equal to that of the sintered product divided by shrinkage factor Sz.

It suffices that the configuration, dimensions and orientation of the compact are controlled as described above.

It also applies to another configuration to control the coordinates (x, y, z) of the compact relative to the coordinates (X, Y, Z) of the sintered product such as to meet the equations: X=Sx.x, Y=Sy.y, and Z=Sz.z by taking into account percent shrinkages S || and S⊥ and aligning the orientation with X axis.

Figure 3:
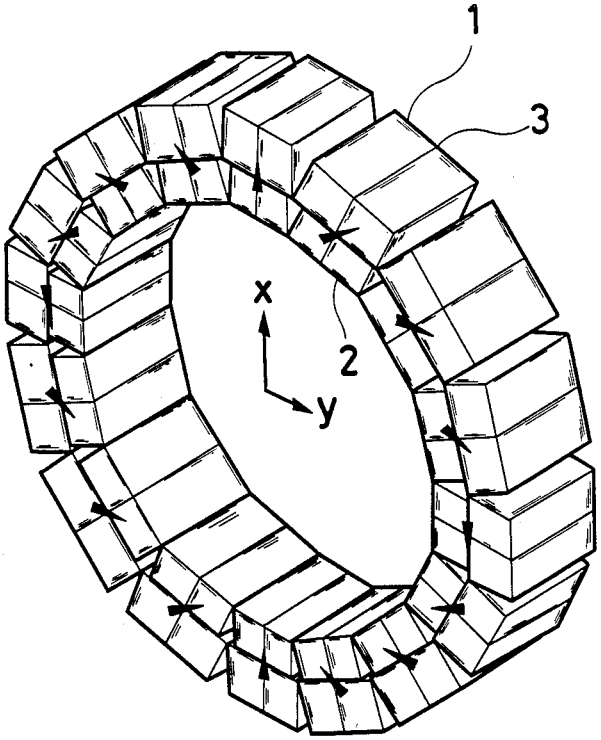
FIG. 3 is a perspective view of a ring magnet circuit to which the sintered magnets according to the present invention are applicable.

Assemblies of magnets as shown in FIG. 3 may be fabricated by preparing a series of sintered magnets having different angles $\theta$ between the axis of easy magnetization and the edge.

According to the present invention, a sintered magnet having a predetermined configuration, dimensions and magnetization direction can be produced by controlling the configuration, dimensions and magnetization direction of a starting compact. The present process has great advantages of ease of manufacture and a low cost because of elimination of machining operation.

EXAMPLES

In order that those skilled in the art will better understand the practice of the present invention, examples of the invention are presented by way of illustration and not by way of limitation.

EXAMPLE 1

A rare earth alloy ingot was prepared by high-frequency heating the starting materials, 99.9% pure electrolytic iron, ferroboron alloy, 99% pure boron, Nd, and another necessary ingredient, and casting the melt into a water-jacketed copper mold. The alloy had the composition of 76.5 at% Fe, 7.9 at% B, 14.8 at% Nd, and 0.8 at% Dy.

A sample of 1.8 cm×2.0 cm×1.5 cm was prepared from this alloy and sintered for shrinkage measurement to find that the percent shrinkages S⊥ and S || were equal to 10.8% and 20.0%, respectively. Then, Sx, Sy and Sz are calculated to equal 0.8, 0.892 and 0.892, respectively.

The alloy ingot was finely divided and then molded into a compact under a pressure of 2 ton/cm$^2$ in a magnetic field of 10 KOe. The compact was sintered at 1100° C. for 3 hours in an argon atmosphere and then allowed to cool.

The above-mentioned process was repeated to produce sintered blocks of rectangular parallelepiped and trapezoidal prism shapes having varying angles between the parallel sides and the magnetization direction. The dimensions of starting compacts and sintered blocks are described below.

Trapezoidal prism
Compact
A'B'=61.6 mm
B'C'=87.5 mm
C'D'=59.7 mm
D'A'=62.0 mm
$\alpha'$=106.3°
$\beta'$=97.9°
$\alpha''$=73.7°
$\beta''$=82.1°
$\theta'$=20.4°
Sintered block (design values in parentheses)
d=51.0 mm (50.32 mm)
b=72.4 mm (71.0 mm)
$\alpha$=101.5° (101.25°)
$\beta$=101.3° (101.25°)
a=52.9 mm (53.0 mm)
c=52.7 mm (53.0 mm)
$\theta$=22.3 ° (22.5°)
Rectangular parallelepiped
Compact
A'B'=C'D'=77.2 mm
B'C'=D'A'=89.1 mm
$\alpha'=\beta''$= 96.2°
$\beta'=\alpha''$=83.8°
$\theta'$=41.89°
Sintered block
a=c=64.8 mm (65.0 mm)

b=d=75.3 mm (75.0 mm)
$\alpha$=90.4° (90.0°)
$\beta$=89.6° (90.0°)
$\theta$=44.9° (45.0°)

EXAMPLE 2

The procedures used were substantially the same as in Example 1.

A rare earth alloy ingot having the composition of 77.7 at% Fe, 6.8 at% B, 13.9 at% Nd, and 1.6 at% Dy was prepared.

The percent shrinkages S⊥ and S || were measured 19.5% and 11.5%, respectively. Then, Sx=0.805, and Sy=Sz=0.885.

The alloy ingot was finely divided, molded into a compact in an applied magnetic field, and then sintered as in Example 1.

The dimensions of starting compacts and sintered blocks are described below.

Rectangular parallelepiped A
Compact
A'B'=C'D'=39.8 mm
B'C'=D'A'=43.2 mm
$\alpha'=\beta''$92.7°
$\beta'=\alpha''$87.3°
$\theta'$=13.7°
Sintered block
a=c=35.1 mm (35.0 mm)
b=d=35.0 mm (35.0 mm)
$\alpha$=90.1° (90°)
$\beta$=89.9° (90°)
$\theta$=15.3° (15°)
Rectangular parallelepiped B
Compact
A'B'=C'D'=40.6 mm
B'C'=D'A'=42.5 mm
$\alpha'=\beta''$=94.7°
$\beta'=\alpha''$=85.3°
$\theta'$=27.7°
Sintered block
a=c=35.1 mm (35.0 mm)
b=d=35.0 mm (35.0 mm)
$\alpha$=90.3° (90°)
$\beta$=89.7° (90°)
$\theta$=30.2° (30°)

As seen from the above data, the present process enables to directly produce a sintered body of the desired dimensions and configuration at a very high degree of precision.

We claim:

1. A process for preparing a sintered magnet, comprising the steps of:
   (a) press molding a magnetic powder into a compact in an applied magnetic field, said compact having coordinates (X/Sx, Y/Sy, Z/Sz) where Sx, Sy and Sz are predetermined factors of shrinkage occurring in a magnetization direction and directions perpendicular to the magnetization direction upon subsequent sintering, and
   (b) sintering the compact into a sintered magnet having a major axis and an axis of easy magnetization oriented at an angle to the major axis, the sintered magnet having coordinates (X, Y, Z) with X axis aligned with the axis of easy magnetization of the sintered magnet.

2. The process of claim 1 wherein the sintered magnet is an iron-boron-rare earth metal magnet.

3. The process of claim 2 wherein Sx has a value of 0.75 to 0.85, and Sy and Sz have values of 0.85 to 0.95.

4. The process of claim 1 wherein the shrinkage factors Sx, Sy and Sz are previously determined by press molding a magnetic powder into a rectangular parallelepiped compact under the same magnetic field as applied in (a), but applied parallel to one edge of said rectangular parallelepiped compact, and sintering the compact under the same conditions as applied in (b).

5. The process of claim 1 wherein the sintered magnet is of a columnar shape having parallel extending major surfaces.

6. The process of claim 5 wherein said major surfaces are substantially parallel to the axis of easy magnetization.

7. The process of claim 6 wherein each said major surface is a quadrangular surface having two parallel sides.

8. The process of claim 7 wherein the following equations are met:

$$a' = a\sqrt{\frac{\cos^2(\theta+\alpha)}{Sx^2}+\frac{\sin^2(\theta+\alpha)}{Sy^2}}$$

$$b' = b\sqrt{\frac{\cos^2\theta}{Sx^2}+\frac{\sin^2\theta}{Sy^2}}$$

$$c' = c\sqrt{\frac{\cos^2(\theta-\beta)}{Sx^2}+\frac{\sin^2(\theta-\beta)}{Sy^2}}$$

$$d' = d\sqrt{\frac{\cos^2\theta}{Sx^2}+\frac{\sin^2\theta}{Sy^2}}$$

$$\alpha' = \cos^{-1}\frac{Sy^2\cos\theta\cos(\theta+\alpha)+Sx^2\sin\theta\sin(\theta+\alpha)}{\sqrt{Sy^2\cos^2(\theta+\alpha)+Sx^2\sin^2(\theta+\alpha)}\ \sqrt{Sy^2\cos^2\theta+Sx^2\sin^2\theta}}$$

$$\beta' = \cos^{-1}\frac{Sy^2\cos\theta\cos(\theta-\beta)+Sx^2\sin\theta\sin(\theta-\beta)}{\sqrt{Sy^2\cos^2(\theta-\beta)+Sx^2\sin^2(\theta-\beta)}\ \sqrt{Sy^2\cos^2\theta+Sx^2\sin^2\theta}}$$

-continued $$\theta' = \tan^{-1}\frac{Sx\tan\theta}{Sy}$$

$$e' = \frac{e}{Sz}$$

where each said major surface of the sintered magnet has four apexes A, B, C and D, side BC being parallel to side AD, sides AB, BC, CD and DA have lengths a, b, c and d, respectively angles DAB and CDA are equal to $\alpha$ and $\beta$, respectively, the distance between the major surfaces is equal to e, the angle of intersection between the axis of easy magnetization and side BC is equal to $\theta$, the major surface of the compact has four apexes A', B', C' and D', side B'C' being parallel to side A'D', sides A'B', B'C', C'D' and D'A' have lengths a', b', c' and d', respectively, angles D'A'B' and C'D'A' are equal to $\alpha'$ and $\beta'$, respectively, the distance between the major surfaces is equal to e', and the angle of intersection between the axis of easy magnetization and side B'C' is equal to $\theta'$.

9. A method for fabricating a sintered magnet assembly, comprising the steps of:

(a) press molding a magnetic powder into a compact in an applied magnetic field, said compact having coordinates (X/Sx, Y/Sy, Z/Sz) where Sx, Sy and Sz are predetermined factors of shrinkage occurring in a magnetization direction and directions perpendicular to the magnetization direction upon subsequent sintering, (b) sintering the compact into a sintered magnet having parallel extending major surfaces with two parallel extending sides and having a major axis within the plane of the major surface and an axis of easy magnetization oriented at an angle to the major axis, the sintered magnet having coordinates (X, Y, Z) with X axis aligned with the axis of easy magnetization of the sintered magnet, (c) repeating steps (a) and (b) to prepare a plurality of sintered magnets having axes of easy magnetization oriented at different angles to the respective major axes, and (d) arranging the plurality of sintered magnets in a ring configuration whereby a predetermined magnetic field is produced within the ring.

10. The method of claim 9 wherein a unidirectional, substantially parallel extending magnetic field is produced within the ring.

11. The method of claim 9 wherein the sintered magnet is an iron-boron-rare earth metal magnet.

12. The method of claim 11 wherein Sx has a value of 0.75 to 0.85, and Sy and Sz have values of 0.85 to 0.95.

13. The method of claim 9 wherein the shrinkage factors Sx, Sy and Sz are previously determined by press molding a magnetic powder into a rectangular parallelepiped compact under the same magnetic field as applied in (a), but applied parallel to one edge of said rectangular parallelepiped compact, and sintering the compact under the same conditions as applied in (b).

14. The method of claim 9 wherein the following equations are met:

$$a' = a\sqrt{\frac{\cos^2(\theta+\alpha)}{Sx^2} + \frac{\sin^2(\theta+\alpha)}{Sy^2}}$$

$$b' = b\sqrt{\frac{\cos^2\theta}{Sx^2} + \frac{\sin^2\theta}{Sy^2}}$$

$$c' = c\sqrt{\frac{\cos^2(\theta-\beta)}{Sx^2} + \frac{\sin^2(\theta-\beta)}{Sy^2}}$$

$$d' = d\sqrt{\frac{\cos^2\theta}{Sx^2} + \frac{\sin^2\theta}{Sy^2}}$$

$$\alpha' = \cos^{-1}\frac{Sy^2\cos\theta\cos(\theta+\alpha) + Sx^2\sin\theta\sin(\theta+\alpha)}{\sqrt{Sy^2\cos^2(\theta+\alpha) + Sx^2\sin^2(\theta+\alpha)}\sqrt{Sy^2\cos^2\theta + Sx^2\sin^2\theta}}$$

$$\beta' = \cos^{-1}\frac{Sy^2\cos\theta\cos(\theta-\beta) + Sx^2\sin\theta\sin(\theta-\beta)}{\sqrt{Sy^2\cos^2(\theta-\beta) + Sx^2\sin^2(\theta-\beta)}\sqrt{Sy^2\cos^2\theta + Sx^2\sin^2\theta}}$$

$$\theta' = \tan^{-1}\frac{Sx\tan\theta}{Sy}$$

$$e' = \frac{e}{Sz}$$

where each said major surface of the sintered magnet has four apexes A, B, C and D, side BC being parallel to side AD, sides AB, BC, CD and DA have lengths a, b, c and d, respectively, angles DAB and CDA are equal to $\alpha$ and $\beta$, respectively, the distance between the major surfaces is equal to e, the angle of intersection between the axis of easy magnetization and side BC is equal to $\theta$, the major surface of the compact has four apexes A', B'C'and D', side B'C' being parallel to side A'D', sides A'B', B'C', C'D' and D'A' have lengths a', b', c' and d', respectively, angles D'A'B' and C'D'A' are equal to $\alpha'$ and $\beta'$, respectively, the distance between the major surfaces is equal to e', and the angle of intersection between the axis of easy magnetization and side B'C' is equal to $\theta'$.

* * * * *